United States Patent [19]

Sandström

[11] Patent Number: 4,870,601

[45] Date of Patent: Sep. 26, 1989

[54] METHOD TO ESTIMATE THE DEGREE OF COMPACTION OBTAINED AT COMPACTION AND MEANS TO MEASURE THE DEGREE OF COMPACTION FOR CARRYING OUT THE METHOD

[75] Inventor: Åke J. Sandström, Sollentuna, Sweden

[73] Assignee: Geodynamik H. Thurner AB, Stockholm, Sweden

[21] Appl. No.: 882,926

[22] PCT Filed: Nov. 19, 1985

[86] PCT No.: PCT/SE85/00472

§ 371 Date: Jun. 11, 1986

§ 102(e) Date: Jun. 11, 1986

[87] PCT Pub. No.: WO86/03237

PCT Pub. Date: Jun. 5, 1986

[30] Foreign Application Priority Data

Nov. 19, 1984 [SE] Sweden ..... 8405801

[51] Int. Cl.[4] ..... E01C 19/28

[52] U.S. Cl. ..... 364/550; 364/550; 404/117

[58] Field of Search ..... 364/505, 550; 404/133, 404/117; 73/573, 594

[56] References Cited

U.S. PATENT DOCUMENTS

| | | | |
|---|---|---|---|
| 4,103,554 | 8/1978 | Thurner | 73/573 |
| 4,149,253 | 4/1979 | Paar et al. | 364/505 |
| 4,212,071 | 7/1980 | Dortu | 364/505 |
| 4,348,901 | 9/1982 | Vural et al. | 73/594 |
| 4,467,652 | 8/1984 | Sandstrom | 73/573 |
| 4,546,425 | 10/1985 | Breitholtz | 364/153 |
| 4,577,995 | 3/1986 | Sadahiro | 404/117 |
| 4,647,247 | 3/1987 | Sandstrom | 404/75 |

FOREIGN PATENT DOCUMENTS

| | | | |
|---|---|---|---|
| 3421824 | 12/1985 | Fed. Rep. of Germany | 404/117 |

*Primary Examiner*—P. S. Lall
*Assistant Examiner*—Thomas G. Black

[57] ABSTRACT

Estimation of the degree of compaction of a bed when using a compacting machine employs an oscillatory principle. The oscillatory compacting machine is arranged to act on the bed by gravitational force and rapidly alternating horizontal force. The method uses a recorded signal from a horizontally mounted sensor connected to the bearing of the roller drum. The system for performing this method, utilizes a processor to calculate results which are presented by a display unit. Beside the acceleration sensor another sensor and a switch are used in order to enable calculation by the processor of different kinds of averages of the compaction meter value and also for determination of travel speed.

10 Claims, 3 Drawing Sheets

METHOD TO ESTIMATE THE DEGREE OF COMPACTION OBTAINED AT COMPACTION AND MEANS TO MEASURE THE DEGREE OF COMPACTION FOR CARRYING OUT THE METHOD

BACKGROUND OF THE PRESENT INVENTION

The present invention relates to a method and means to estimate the degree of compaction obtained when compacting a bed with the aid of a compacting machine of a certain kind. The method and the means are meant for such compacting machines having a compacting drum which is rotatably suspended about its axis and operates according to the principle described in European Pat. No. 0053598. The principle is that a torque is applied to the compacting drum about its axis. The torque changes direction between clockwise and counter-clockwise rotation with a certain frequency of reversal.

There has been a long time desire for a simple, cheap and dependable continuous meter for measuring the degree of compaction which is attained during the compaction of a bed. In recent years there have been several different meters designed to meet this desire, i.e., for conventional vibrating rollers. Examples are mentioned of such designs in U.S. Pat. No. 4,103,554 and European Pat. No. 0,065,544. The compacting machines for which the present invention is directed to, function in a principally different manner then ordinary vibrating rollers. Compaction meters, e.g. according to U.S. Pat. No. 4,103,554 and European Pat. No. 0065544 can therefore not be used for the type of compacting machine contemplated by the present invention. There is no generally known method or means for estimation of the compaction degree attained by the type of compaction machine contemplated by the present invention. The present invention utilizes a method and a means which continuously estimates the attained degree of compaction during compaction work with precisely this type of compacting machine. The meter is located on the roller.

The present invention is based on sensing the motion of the compacting drum when the compacting machine is moved forward and backwards across the top of the bed and the alternating torque being applied to the compacting drum about its axis.

The present invention is based on the knowledge that the acceleration of the drum about its center or axis in a direction perpendicular to the drum axis and substantially parallel to the bed is related to the degree of compaction of the bed. Therefore, a value is generated in a method according to the invention which represents this acceleration. A device according to the invention, is also needed for generation of such a quantity.

The present invention is also based on the knowledge that the acceleration amplitude need not be directly related to the degree of compaction since the compacting drum can also slide against the bed. The present invention is based on the knowledge that an estimation of the attained degree of compaction can be made with the aid of the acceleration at certain points of time or when certain time intervals during the drum mantle remains in contact with the bed, but, contrary to the application of the alternating torque, not slip appreciably against the bed. In the method, according to the present invention, at least one such time interval or point of time is determined with the aid of the generated value. Furthermore, the frequency of reversal or its corresponding period or a parameter which is a function of these conditions is determined with the aid of the time plot of the measured acceleration during those time intervals described above and the frequency of reversal or the period. Means, according the present invention, embodies a transducer for sensing the motion of the drum and a processor for calculating the obtained degree of compaction.

SUMMARY OF THE PRESENT INVENTION

According to a preferred embodiment of a method, according to the present invention, one determines the amplitude of the sine curve, the frequency of which coincides with the frequency of reversal, and the time plot of the acceleration of which substationally coincides with the acceleration being measured course during at least significant parts of at least one such prescribed time interval. The attained degree of compaction is then estimated with the aid of the amplitude of said sine curve.

According to another preferred embodiment, the rate of change of the acceleration at points of time when the acceleration is substantially zero is determined. The time difference between two successive points when the acceleration is zero is also determined. A product substantially proportional to both the rate of change and the time difference is determined and the attained degree of compaction is estimated with the aid of this product.

According to one embodiment of the present invention, a mean value computation is used to reduce the influence of disturbances. For this purpose, means according to the present invention, may have a transducer for sensing the turning motion of the drum about its axis.

BRIEF DESCRIPTION OF THE DRAWINGS

A detailed description of the invention will below be given with reference to the appended drawings.

DETAILED DESCRIPTION OF THE PRESENT INVENTION

It will simplify the understanding of the present invention if the function of the precise kind of compacting machine to which the invention is directed, is well known. In connection with the description of the present invention it may, therefore, be suitable to describe the compacting machine to which the invention is directed.

The principle for the compacting machines which are described in European Pat. No. 0053598 is that the drum (1) is excited by an alternating torque about the drum axis. The torque can, e.g., be generated by an eccentric system inside the drum which is driven by a hydraulic motor (2). The torque is preferrably varied sinusoidally with time and changes direction between clockwise and counterclockwise rotation with a frequency of reversal of the order of 20–50 Hz. Superimposed on the motion, due to the traction of the roller and due to the applied torque, is an oscillatory motion which causes the drum to transmit an oscillatory force to the bed. The oscillatory force will act principally parallel to the top surface of the bed and have a dominating frequency which coincides with the frequency of reversal of the applied torque.

The drum is connected to the frame of the roller (3) by springs, normally comprising rubber elements (not showned in the figure). The frame of the roller (3) often consists of two articulated parts. The rear part can, as in FIG. 1, be a tractor unit comprising a traction motor, traction wheels and a drivers seat, but it can also consist of a second drum section.

Figure 2:
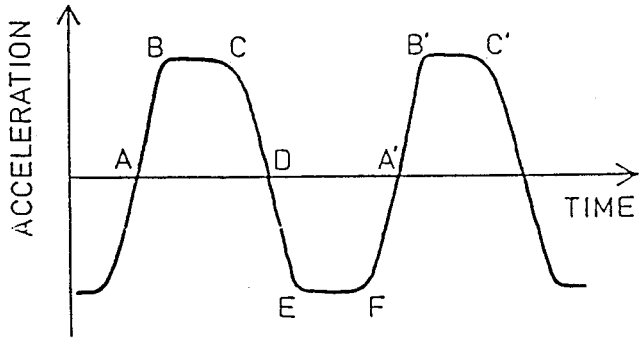
FIG. 2 illustrates the time plot of the horizontal acceration of the drum axis in the case when a certain slip takes place between the drum mantle and the bed which is being compacted.

When the roller moves with constant travel speed over a bed and the drum is excitated with an alternating torque, the drum axis will—in a direction parallel to the bed and perpendicular to the axis—have a time varying acceleration, which in principle resembles the one shown in FIG. 2. During such time intervals the drum mantle is in contact with the bed without any appreciable sliding—intervals CDE, FA'B' and so on. During the intervals BC, EF and so on, the friction between the drum mantle and the bed not great enough to maintain contact. The mantle of the drum is then slides—with a fairly constant transfer or force—against the bed. This is reflected as a fairly constant magnitude of the acceleration of the drum axis.

Figure 1:
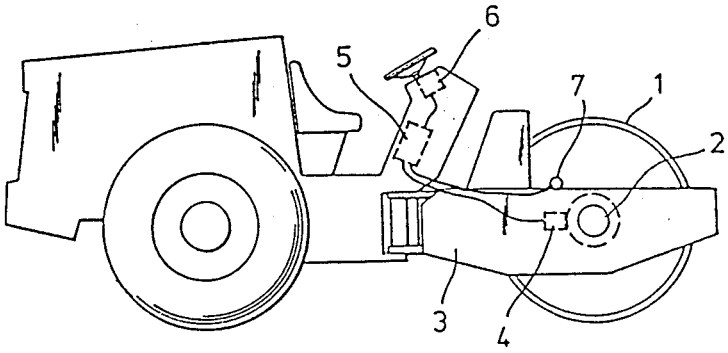
FIG. 1 illustrates an example of the general design of a roller of the type to which the present invention is directed.

The method, according to the present invention, is based on sensing the motion of the compacting drum, e.g., with a sensor (4) according to FIG. 1 and of generating a first value representing the acceleration of the drum center or axis in a direction perpendicular to the drum axis and substantially parallel to the bed. The signal is treated with regard to generation of a value which is propotional to the stiffness of the bed, i.e. of, its degree of compaction.

This treatment of the signal can most easily be described starting with FIG. 2. At first two points of time are decided when the curve has the same phase, e.g., A and A. Then the time interval between those two points, i.e. the period, is determined. As the next step, the inclination of the curve at at least one zero crossing of the curve is calculated. The desired parameter is then calculated as the product of the length of the time interval and the amplitude of the inclination. The value is finally multiplied with a suitable scaling constant before it is presented as a value of the degree of compaction. As alternative methods, time intervals near the zero crossings or the major part of the signals during which the drum does not appreciably slip against the bed, can be used for estimation of the rate of change of the acceleration. In those cases, either straight lines or a sine function is adapted to the curve parts. The adaptation can be made in accordance with the method of least squares. In the case, where a sine function is adapted, a frequency of the sine function is chosen such that it coincides with the inverted value of the length of the time interval (the period) which was calculated above. This frequency corresponds to the frequency of reversal of the torque by which the compaction drum is excitated. The desired parameter which is related to the degree of compaction (stiffness) is the amplitude of the adapted sine function.

The adapted signal can also consist of a sum of a sine function and a number of harmonic overtones of this sine function. The amplitudes and phases of those overtones relative to the fundamental tone will have certain prescribed values.

The frequency of reversal can alternatively be determined through a direct detection of the rotation of the eccentric system with a suitable transducer.

The above described method gives results which can be used for comparative measurements at the same frequency of excitation. If comparative parameter values for different excitation frequencies are desired, the parameter value is calculated as a function of the amplitude of the adapted sine function as well as of the excitation frequency.

The method, according to the present invention, also gives a possibility to indicate the degree of slip with the aid of the first value. This has great value concerning judgement of the suitable vibration amplitude and its respective frequency with regard to the compaction efficiency. A suitable measure is the quotient between the amplitude of the first value and the amplitude of the adapted sine function, or alternatively, one minus this quotient.

In order to even out fluctuations of the estimated degree of compaction from one period to the next, a mean value computation of estimated values from more than one period is carried out.

Because of incomplete dynamic balancing of different parts of the drum, it can occur that the parameter shows a periodicity which depends on these imbalances and not on the degree of compaction of the bed. Such periodicities can be eliminated by forming a running mean value of the parameter over the latest complete revolution of the drum. In this case the drum rotation is detected by a separate sensor (7).

Figure 3:
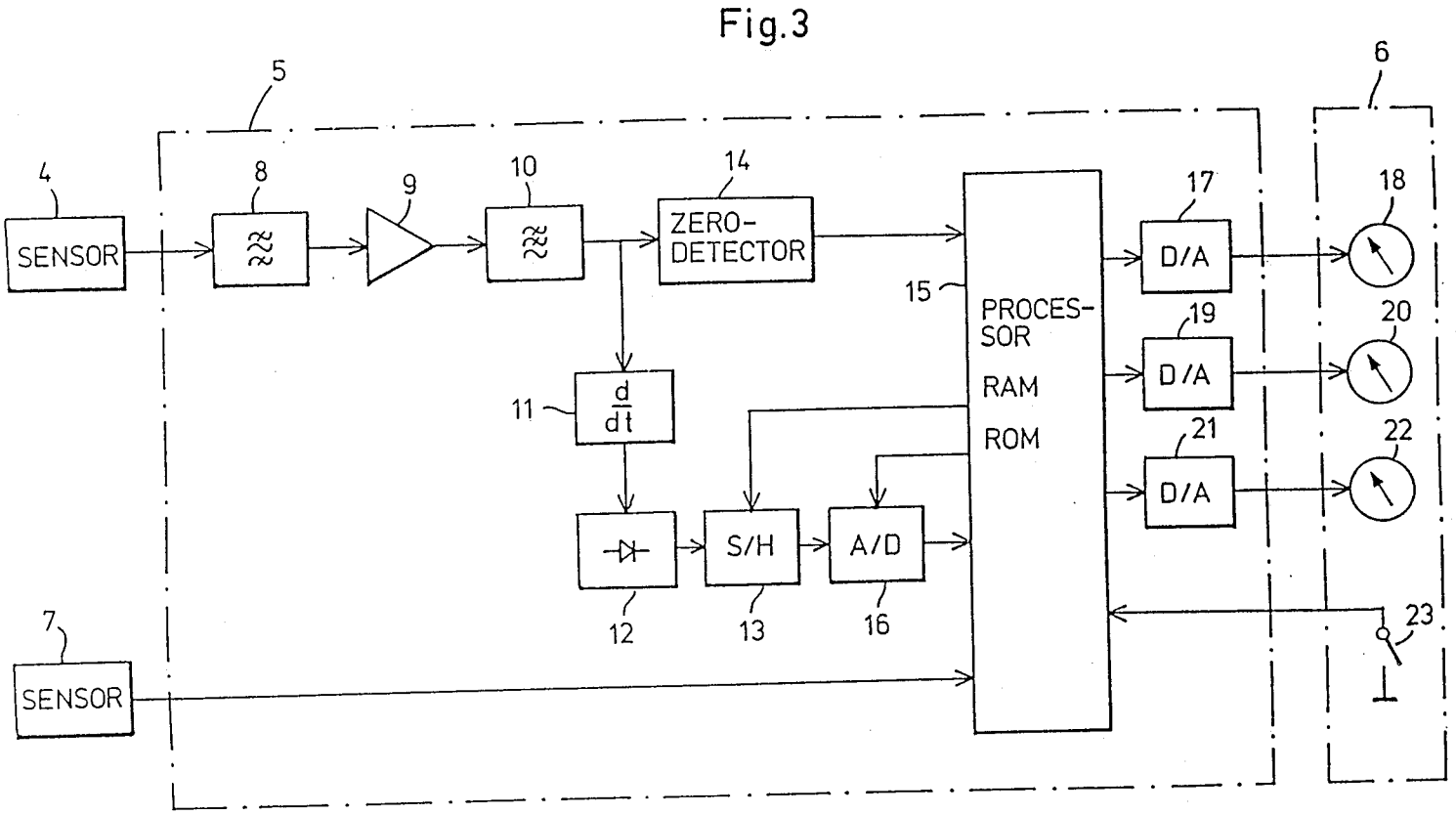
FIG. 3 illustrates an embodiment of a device for reducing the influences of disturbances on the present invention.

FIG. 3 shows a block diagram of a preferred embodiment of the device for carring out the method mentioned above. (4) is a sensor mounted in a plane through the drum axis which is substantially parallel to the bed and perpendicular to this axis. The sensor is preferrably mounted in contact with the bearing of the drum. The sensor comprises an accelerometer and an amplifier.

The signal from the sensor is transmitted through a cable in the calculation unit (5) mounted in a convenient way on the roller. The result is shown on a display unit (6) which is usually placed in the instrument panel of the roller.

Another sensor (7) is connected to (5). It can be of an inductive type sensor which senses the drum rotation and gives a certain number of pulses per complete revolution of the drum. The number of pulses per entire revolution is of the order of eight or more.

In the calculation unit, the output from the sensor is first fed to a bandpass filter (8), which attenuates low and high frequencies which are disturbances and may cause saturation in the subsequent amplifier (9). High frequencies from vibrations in bearings and from the eccentric motor, resonances, etc are then attenuated further by a low pass filter (10).

The output from the low pass filter is the first value. Points of time when the drum mantle is in contact with the bed, but, contrary to the application of the alternating torque, does not slip appreciably against the bed, are determined by conveying the first value to a zero crossing detector (14). At zero crossings of the first value, no slip is occuring, compare FIG. 2.

The timelapses between successive zero crossings are approximately equal to half the period of the oscillation. With aid of the output from the zero crossing detector, the processor can also generate a second value representing the frequency of reversal or its corresponding period or a parameter which is directly dependant upon these conditions.

The output from the filter (10) is also fed to a derivation body (11). There, a certain bandpass filtering is performed, meaning that the derivation is made only in a limited frequency interval corresponding to possible roller excitation frequencies. The divided signal is full wave rectified in block (12) and supplied to a sample/-hold circuit (13). Sampling pulses to (13) are generated by the processor with its RAM and ROM containing a suitable program (15) and with the aid of the zero crossing detector (14).

The zero crossing detector has a certain hysteresis to prevent remaining extra zero crossings in the signal from being detected because of high frequency noise. The output from the sample/hold-circuit (13) correspond to the absolute value of the derivative of the signal at a zero crossing in a positive or negative direction, respectively. The value is kept constant from one zero crossing to the next.

The signal from (13) is converted to digital form by an A/D-converter (16). When the conversion is terminated the value is read into the processor (15). The processor then calculates partly one second value representing the frequency of reversal by measuring the time between two zero crossing pulses from (14) and partly the quotient between the maximum of the signal derivative which comes from (16) and the above mentioned frequency of reversal. Alternatively a digital value is calculated for the second value representing the period of the oscillation and the product of the mentioned maximum and the period.

At least theoretically, the values of the product and the quotient should be corrected for variation of the frequency in reversal. Tests have, however, shown that the above mentioned product and quotient are constant enough within a normal band of variation of the excitation frequency for ordinary rollers to make corrections unnecessary. In cases where correction for frequency is needed, this can be performed by the processor with the aid of a short program sequence.

After correction of the value of the product and the quotient, the value is outputted in the form of a digital word from the processor to an D/A converter (17). This converts the value to an analogue voltage (or current), which in turn is supplied through a cable to an indicator instrument (18) in the display unit (6). In a corresponding manner, a value of the fundamental frequency of the signal can be generated via another D/A-converter (19) and be presented on an indicator instrument (20).

An attempt to explain theoretically why a function of the product and the quotient will give the measure of the compaction degree is that the product and the quotient after a suitable scaling corresponds to the amplitude of the sine signal which has the same fundamental frequency as the recorded acceleration signal and which also has the same derivative at the zero crossing. This is the desired amplitude which closely corresponds to the amplitude which would have been recorded if no slip had taken place between the drum mantle and the bed and which gives a measure of the compaction degree of the bed.

An alternative device, according to the present invention, which connects to this theoretical explanation uses the same hardware described above and which is shown in FIG. 3, but with the difference that the derivation circuit (11) and the full wave rectifier (12) are discarded. The signal from the filter (10) is thus fed directly the sample/hold circuit (13) as well as to the zero detector (14). Sampling and A/D-convertion of the signal is performed continuously during time lapses of at least one period of the oscillation, during which digitalized values are successively stored in the memory of the processor (15). Information is also stored regarding the points of time from the zero crossing detector (14) in relation to the stored acceleration data. When enough values have been stored, the processor performes an adaptation according to the method of least squares of a theoretical function to prescribed parts of the stored signal as mentioned above. As a measure of the attained degree of compaction, the processor calculates a digital number directly dependent on the amplitude of the sine function. In the simplest case, this number is proportional to the amplitude. More complicated relationships between the number and the amplitude are possible. The number can, e.g., be a linear function of the amplitude with constants and factors being functions of the frequency of reversal. The calculated digital number is outputted to a D/A-converter. Sampling and D/A-conversion is then started again and the procedure is repeated.

The sensor (7) has two main tasks. The pulse train which it generates, when the roller moves, gives the processor a possibility to calculate a value of the roller speed, which via a D/A-converter (21) is transmitted to an indicator instrument (22). The pulses from (7) are also used to control a mean value calculation procedure in the processor. Mean values are calculate successively for an complete revolution of the drum. The mean value is updated at every new pulse from the sensor (7). These mean values are in this case outputted to the D/A-converter (17) and the instrument (18) instead of the instantaneous compaction meter value mentioned above.

The motive for this mean value calculation is to even out possible fluctuations of the compaction meter value which arises due to imperfect balancing of the eccentric system of the oscillating drum.

Another mean value function has also been programmed. It is controlled by a switch (23). With the aid of this function, the mean value over a stretch of suitable length can be calculated and presented. The mean value calculation is started by operating a switch (23). During the time the switch is on, values for the compaction degree are successively stored in a register of the processor. The normal compaction value is simultaneously displayed in the usual way on the indicator instrument (18). At the end of the stretch, switch (23) is operated again. The mean value over the test strip in question is then calculated and displayed on the indicator instrument until a new mean value generation is started by operating the switch (23) again.

Figure 4:
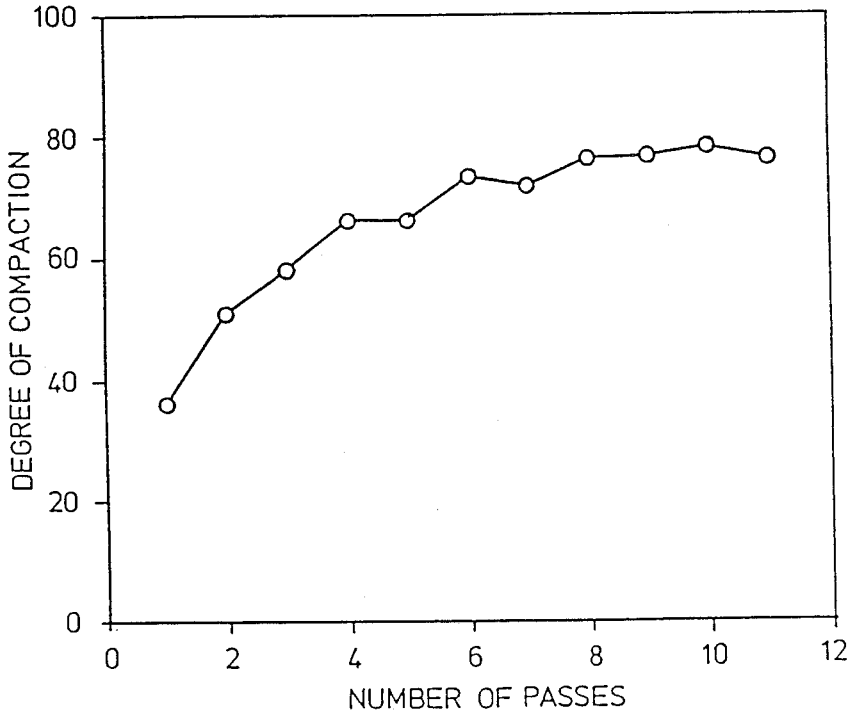
FIG. 4 illustrates the estimated degree of compaction as a function of the number of times the compacting machine has been moved over the bed, using a method and the device of FIG. 3, according to the present invention.

A prototype built according to the invention has been evaluated at tests on different types of beds. In FIG. 4 is shown an example of the increase of the value with the number of passes at the compaction of a gravel bed. The course of the curve agrees well with the increase of the stiffness of the material with increasing number of passes, which can be measured with conventional point test methods.

I claim:

1. A method for estimating a compaction degree attained during compaction of a bed with a compacting machine which has a compacting drum rotatably connected to an axis and which can be moved forwards and backwards on top of the bed, the compaction drum for compaction of the bed being applied with a torque about the axis of the compaction drum which changes rotational direction between clockwise and counter-clockwise with a certain frequency of reversal to cause an oscillatory force to be applied to the bed, comprising the steps of:

(a) sensing acceleration due to the oscillatory force of the compaction drum;

(b) generating a first value representing the acceleration for the center or axis of the drum in a direction perpendicular to the drum axis and approximately parallel to the bed;

(c) determining, by using the first value, at least one point of time or time interval when the compacting drum is in contact with the bed but where no appreciable slip is measured with respect to the bed and compaction drum;

(d) determining any one of the frequency of reversal and a period corresponding to the frequency of reversal and a parameter which is directly dependent upon one of these conditions;

(e) generating a second value representing the frequency of reversal or the period or the parameter described in said step (d); and (f) estimating the degree of compaction attained by using the second quantity and the sensed acceleration sensed during at least one predetermined point of time or during at least part of a predetermined time interval.

2. The method as claimed in claim 1, wherein said step (c) comprises the steps of:

(g) determining points of time when the sensed acceleration of step (a) is substantially zero or time intervals when the sensed acceleration of step (a) is substantially coinciding with its mean value;

(h) determining a rate of change of the sensed acceleration of step (a) when the sensed acceleration is zero or when the sensed acceleration is substantially equal to its mean value; and (i) generating a product substantially proportional to both the rate of change determined in said step (h) and a period corresponding to the frequency of reversal.

3. The method as claimed in claim 2, further comprising the steps of:

(j) sensing a turning motion of the compaction drum about its axis during its movement forwards and backwards on top of the bed; and (k) calculating a mean value of the product during a turning motion of one or several complete revolutions.

4. The method as claimed in claim 1, further comprising the steps of:

(l) determining by using a method of least squares an amplitude of a sine curve, the sine curve being an approximation of the sensed acceleration plotted against time, the sine curve having a frequency which coincides with the frequency of reversal, the least squares method being performed upon values sensed during a period of time corresponding to the predetermined time interval of said step (f); and (m) estimating a degree of compaction using the amplitude of said step (e).

5. The method as claimed in claim 4, further comprises the steps of:

(n) estimating a degree of slip between the compaction drum and the bed which is being compacted, the degree of slip being a function of a ratio between the amplitude of the sine curve and the amplitude of the acceleration.

6. A device for estimating a degree of compaction during a compaction of a bed with a compacting machine having a compacting drum, rotatably connected to an axis and which can be moved forwards and backwards on top of the bed, the compaction drum for the compaction of the bed is applied with a torque about the axis of the compacting drum, the torque changing rotational direction between clockwise and counter-clockwise with a certain frequency of reversal to cause an oscillatory force to be applied to the bed, comprising:

first sensor means for sensing an acceleration due to the oscillatory force of the compaction drum and for generating a first value representing the sensed acceleration for a center or axis of the drum in a direction perpendicular to the drum axis and substantially parallel to the bed on which the compaction drum is moved forwards and backwards;

contact determining means for determining, by using said first value), points of time or time intervals when the compaction drum is in contact with the bed and no appreciable slip is present;

processing means for generating a second value representing any one of the frequency of reversal and a corresponding period corresponding to the frequency of reversal and a parameter which is directly dependent upon one of these conditions; and estimating means for a degree of compaction by using said second quantity and the sensed acceleration occurring during at least one predetermined point of time or during at least a significant part of at least one predetermined time interval.

7. The device as claimed in claim 6, wherein said processing means uses a method of least squares to determine an amplitude of a sine curve, said sine curve being an approximation of the sensed acceleration plotted against time, said sine curve having a frequency which coincides with the frequency of reversal and said method being performed upon the values sensed during a period of time which substantially coincides with said predetermined time interval.

8. The device as claimed in claim 6, further comprising:

second sensor means operatively connected to the compaction drum for sensing a turning motion of the compaction drum about its axis during the motion forward and backwards on top of the bed; and calculating means for performing a mean value calculation upon the degree of compaction attained during the turning motion of at least one complete revolution.

9. The device as claimed in claim 6, wherein said contact determining means includes detector means for determining points of time when a magnitude of the acceleration is substantially zero or the magnitude of the acceleration substantially coincides with its mean value; and wherein said processing means includes, means for determining a rate of change of the acceleration, time difference means for determining a time difference between two successive points of time corresponding to points of time where the sensed acceleration has a magnitude of zero or a magnitude substantially coinciding with its mean value; and multiplying means for producing a product proportional to said rate of change and said time difference.

10. A method for estimating a compaction degree attained during compaction of a bed with a compacting machine which has a compacting drum rotatably connected to an axis and which can be moved forwards and backwards on top of the bed, the compaction drum for compaction of the bed being applied with a torque about the axis of the compaction drums, which changes between clockwise and counter-clockwise with a certain frequency of reversal to cause an oscillatory force to be applied to the bed, comprising the steps of:

(a) sensing acceleration due to the oscillatory force of the compaction drum;

(b) generating a first value representing the acceleration for the center or axis of the drum in a direction approximately parallel to the bed;

(c) determining, by using the first value, at least one point of time or time interval when the compacting drum is in contact with the bed but where no appreciable slip is measured with respect to the bed and compaction drum;

(d) determining any one of the frequency of reversal and a corresponding period corresponding to the frequency of reversal and a parameter which is directly dependent upon one of these conditions;

(e) generating a second value representing the frequency of reversal or the period or the parameter described in said step (d); and (f) estimating the degree of compaction attained by using the second quantity and the sensed acceleration sensed during at least one predetermined point of time or during at least part of a predetermined time interval.

* * * * *